US007739783B1

(12) United States Patent
Jacobsen

(10) Patent No.: US 7,739,783 B1
(45) Date of Patent: Jun. 22, 2010

(54) HEAD PROTECTION SYSTEM AND METHOD

(75) Inventor: Gregg T. Jacobsen, Capitola, CA (US)

(73) Assignee: Bell Sports, Inc., Santa Cruz, CA (US)

( * ) Notice: Subject to any disclaimer, the term of this patent is extended or adjusted under 35 U.S.C. 154(b) by 759 days.

(21) Appl. No.: 11/427,518

(22) Filed: Jun. 29, 2006

Related U.S. Application Data

(62) Division of application No. 10/898,598, filed on Jul. 23, 2004, now Pat. No. 7,069,601.

(51) Int. Cl.

| | |
|---|---|
| ***B21B 1/46*** | (2006.01) |
| ***B21B 13/22*** | (2006.01) |
| ***B22D 11/126*** | (2006.01) |
| ***B22D 11/128*** | (2006.01) |
| ***B23P 17/00*** | (2006.01) |
| ***B23P 25/00*** | (2006.01) |
| *A42B 3/00* | (2006.01) |
| *A42B 7/00* | (2006.01) |

(52) U.S. Cl. ..... 29/527.1; 2/411; 2/421

(58) Field of Classification Search ..... 2/410, 2/411, 421; 29/527.1

See application file for complete search history.

(56) References Cited

U.S. PATENT DOCUMENTS

| | | | | |
|---|---|---|---|---|
| 4,081,865 | A | 4/1978 | Bergee et al. | 2/425 |
| 4,115,874 | A | 9/1978 | Hasegawa | 2/425 |
| 5,007,141 | A | 4/1991 | Gentes | 24/163 R |
| 5,088,130 | A * | 2/1992 | Chiarella | 2/411 |
| 5,093,937 | A | 3/1992 | Kamata | 2/424 |
| 5,093,938 | A | 3/1992 | Kamata | 2/424 |
| 5,099,523 | A * | 3/1992 | Broersma | 2/411 |
| 5,119,516 | A * | 6/1992 | Broersma | 2/411 |
| 5,231,703 | A | 8/1993 | Garneau | 2/414 |
| 5,269,025 | A | 12/1993 | Broersma | 2/411 |
| 5,309,576 | A | 5/1994 | Broersma | 2/412 |
| 5,351,341 | A | 10/1994 | Broersma | 2/412 |
| 5,351,342 | A | 10/1994 | Garneau | 2/414 |
| 5,469,583 | A | 11/1995 | Akeley et al. | 2/421 |
| 5,477,563 | A * | 12/1995 | Gentes et al. | 2/411 |
| 5,481,762 | A * | 1/1996 | Gentes et al. | 2/411 |

(Continued)

FOREIGN PATENT DOCUMENTS

| | | |
|---|---|---|
| EP | 0 517 091 | 12/1992 |

(Continued)

OTHER PUBLICATIONS

Notification of Transmittal of International Search Report, mailed Oct. 17, 2005, regarding International Application No. PCT/US2005/253718.0-2314, 3 pages.

*Primary Examiner*—David P Bryant
*Assistant Examiner*—Christopher M Koehler
(74) *Attorney, Agent, or Firm*—Baker Botts L.L.P.

(57) ABSTRACT

According to some embodiments of the invention, a system for securing a helmet to the head of a user is provided. The system includes a helmet body, and a roll cage disposed substantially within the helmet body. The system also includes at least a portion of a helmet retention system coupled to the roll cage so that a force applied to the strap is transferred to the roll cage before being transferred to the helmet body.

6 Claims, 5 Drawing Sheets

U.S. PATENT DOCUMENTS

| | | | | |
|---|---|---|---|---|
| 5,619,756 | A | 4/1997 | Garneau | 2/425 |
| 5,659,900 | A | 8/1997 | Arney et al. | 2/417 |
| 5,675,843 | A | 10/1997 | Grim et al. | 2/422 |
| 5,729,877 | A | 3/1998 | Kong et al. | 24/625 |
| 5,774,901 | A | 7/1998 | Minami | 2/421 |
| 5,833,796 | A | 11/1998 | Matich | 156/285 |
| 5,867,840 | A | 2/1999 | Hirosawa et al. | 2/414 |
| 5,887,288 | A * | 3/1999 | Arney et al. | 2/421 |
| 6,009,561 | A | 1/2000 | Bullock et al. | 2/422 |
| 6,009,562 | A | 1/2000 | Bullock et al. | 2/422 |
| 6,401,261 | B1 | 6/2002 | Arney et al. | 2/421 |
| 6,421,840 | B1 | 7/2002 | Chen et al. | 2/410 |
| 6,446,270 | B1 | 9/2002 | Durr | 2/412 |
| 6,449,776 | B1 | 9/2002 | Musai | 2/421 |
| 6,694,529 | B1 * | 2/2004 | Chiu | 2/411 |
| 6,711,751 | B1 | 3/2004 | Muskovitz | 2/410 |
| 2002/0124298 | A1 | 9/2002 | Muskovitz | 2/410 |

FOREIGN PATENT DOCUMENTS

| | | |
|---|---|---|
| JP | 10-130939 | 5/1998 |
| WO | WO 2004/006706 | 1/2004 |

* cited by examiner

HEAD PROTECTION SYSTEM AND METHOD

RELATED APPLICATIONS

This application is a divisional of U.S. application Ser. No. 10/898,598, filed Jul. 23, 2004 entitled "Head Protection System and Method," now U.S. Pat. No. 7,069,601.

TECHNICAL FIELD OF THE INVENTION

This invention relates generally to protective gear and more particularly to a head protection system and method.

BACKGROUND OF THE INVENTION

A physical impact to the head of a person may cause serious injury or death. To reduce the probability of such consequences, protective gear, such as a helmet, is often used in activities that are associated with an increased level of risk for a head injury. Examples of such activities include, but are not limited to, skiing, snowboarding, bicycling, rollerblading, rock climbing, skate boarding, and motorcycling. In general, a helmet is designed to maintain its structural integrity and stay secured to the head of a wearer during an impact.

SUMMARY OF THE INVENTION

According to some embodiments of the invention, a system for securing a helmet to the head of a user is provided. The system includes a helmet body, and a roll cage disposed substantially within the helmet body. The system also includes at least a portion of a helmet retention system coupled to the roll cage so that a force applied to the strap is transferred to the roll cage before being transferred to the helmet body.

According to some embodiments of the invention, a system for head protection is provided. The system includes a helmet body having an outer surface and defining a plurality of holes disposed in a pattern. The helmet body comprises a first material. The system also includes a protective layer that comprises a second material and coupled to at least a portion of the outer surface. The system also includes a roll cage disposed substantially within the helmet body. The system also includes a support layer disposed at least partially within the helmet body. The support layer comprises a third material that is tougher than the first material.

Some embodiments of the invention provide numerous technical advantages. Other embodiments may realize some, none, or all of these advantages. For example, according to one embodiment, a strap hanger is coupled to a helmet without using an anchor that is visible from the external surface of the helmet by coupling the strap hanger to a roll cage disposed within the body of the helmet. In another embodiment, a strap is coupled to a helmet without using an anchor that is visible from the external surface of the helmet by coupling the strap to a roll cage disposed within the body of the helmet. In another embodiment, the structure integrity of the helmet is enhanced by using a support layer that is at least partially disposed outwardly from the external surface of the helmet body.

Other advantages may be readily ascertainable by those skilled in the art.

BRIEF DESCRIPTION OF THE DRAWINGS

Reference is now made to the following description taken in conjunction with the accompanying drawings, wherein like reference numbers represent like parts, in which.

DETAILED DESCRIPTION OF EXAMPLE EMBODIMENTS OF THE INVENTION

Embodiments of the invention are best understood by referring to FIGS. 1-6 of the drawings, like numerals being used for like and corresponding parts of the various drawings.

Figure 1:
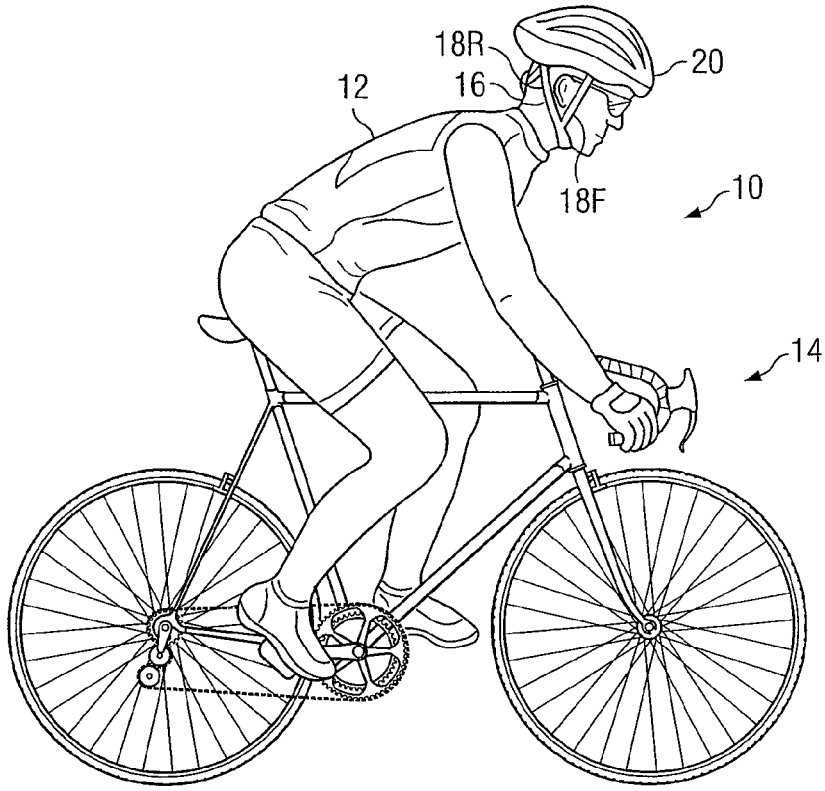
FIG. 1 is a diagram illustrating one embodiment of an environment in which a helmet may be used.

FIG. 1 is a schematic diagram illustrating one embodiment of an environment 10 in which a helmet 20 according to one or more embodiments of the present invention may be used. As shown in FIG. 1, environment 10 includes a bicyclist (user) 12 riding a bicycle 14 and wearing helmet 20 on a head 16 of user 12. Helmet 20 is secured to head 16 through the use of front straps 18F and rear straps 18R, collectively referred to as straps 18. Straps 18, along with any other devices having a primary function of securing helmet 20 to head 16, are collectively referred to as "a helmet retention system." The term "helmet" is used in this document to include any type of protective head gear, such as a bicycle helmet, a motorcycle helmet, and a hard hat. Although helmet 20 is used as an example to describe some embodiments of the present invention, any type of helmet, both protective and non-protective, may benefit from the teachings of the present invention.

Referring again to FIG. 1, if user 12 were to accidentally fall off of bicycle 14, user 12 may suffer various injuries, including an impact to head 16. Because the use of a protective head gear such as helmet 20 may reduce the severity of trauma to head 16 in case of an impact, the use of helmet 20 is strongly encouraged for many activities where the probability of injury to head 16 is relatively high. In general, a helmet is designed to remain secured to head 16 during the impact and maintain its structural integrity to better protect head 16. Many helmet wearers also desire a helmet that has an attractive appearance. For example, many users find a sleek external appearance of a helmet to be attractive.

According to some embodiments of the present invention, a method and system for protecting the head of a helmet wearer is provided by coupling a strap and/or strap hanger to a roll cage that is disposed within the body of helmet 20. In another embodiment, a support layer disposed over portions the outer surface of the helmet body is provided to enhance structural integrity of helmet 20. Additional details of example embodiments of the invention are described below in greater detail in conjunction with FIGS. 2A through 6.

Figure 2D:
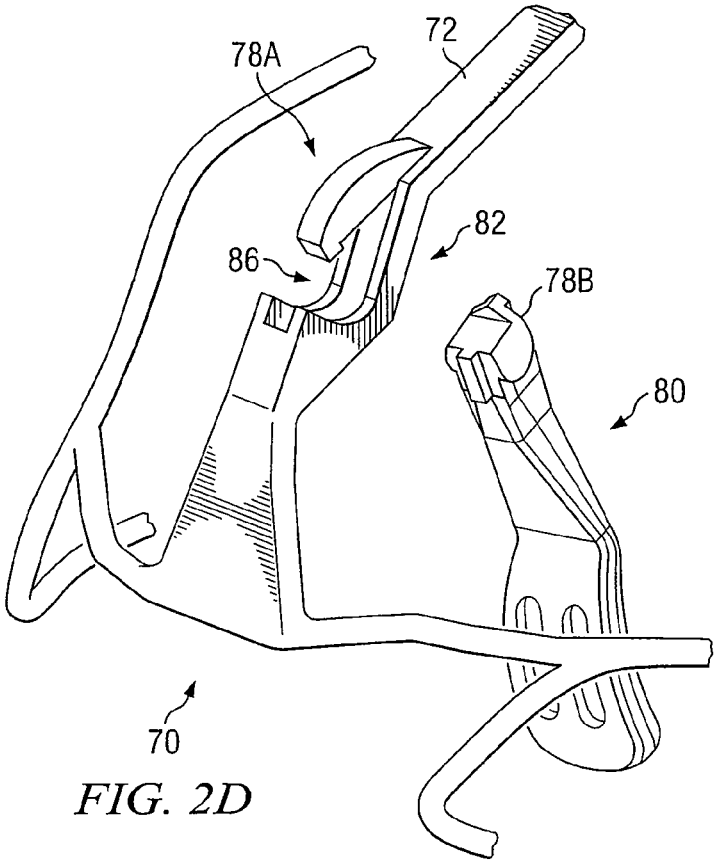
FIG. 2D is a schematic diagram illustrating a perspective view of one embodiment of an attachment point of the roll cage shown in FIG. 2C.
Figure 2A:
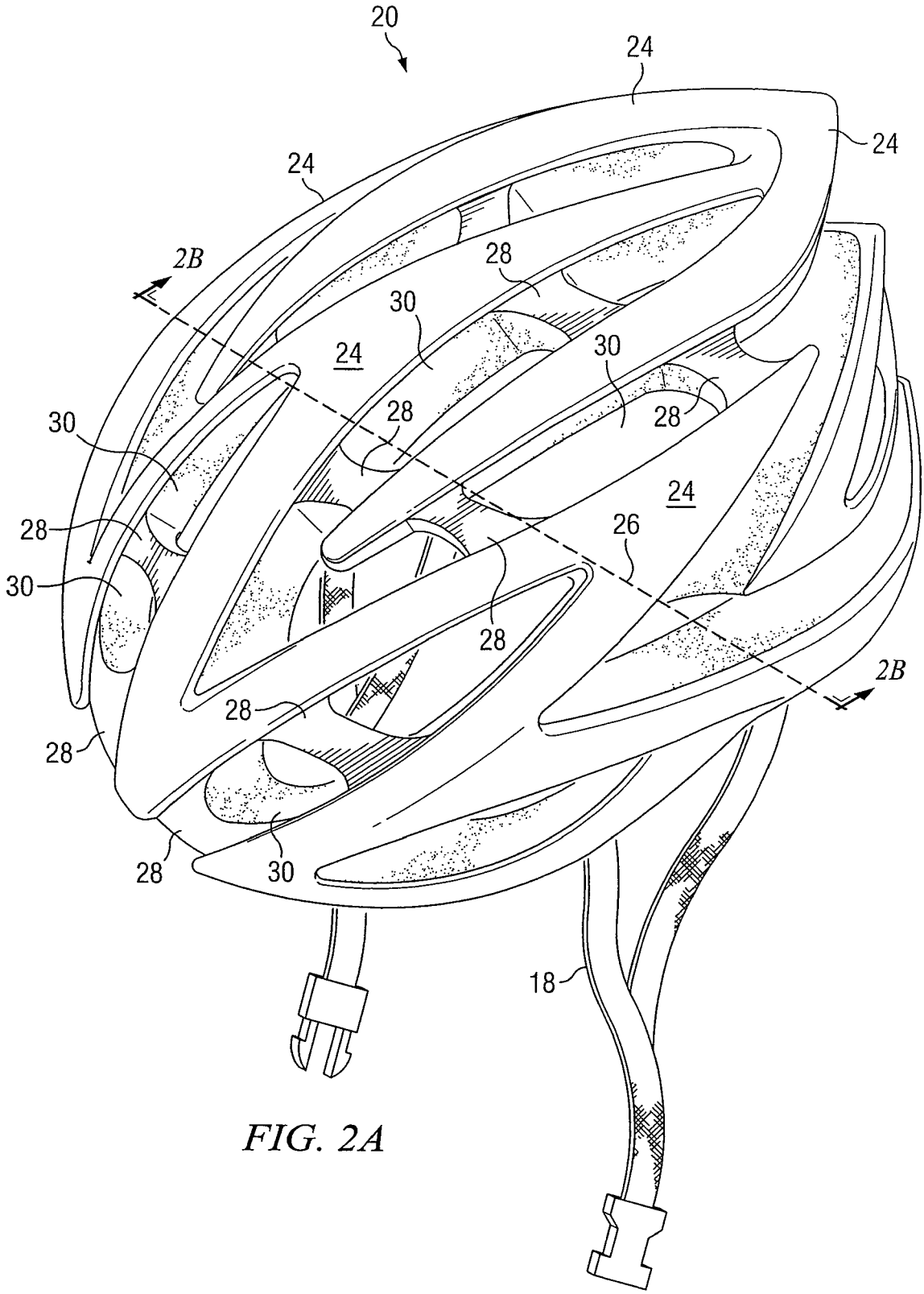
FIG. 2A is a schematic diagram illustrating a perspective view of one embodiment of the helmet shown in FIG. 1.
Figure 2B:
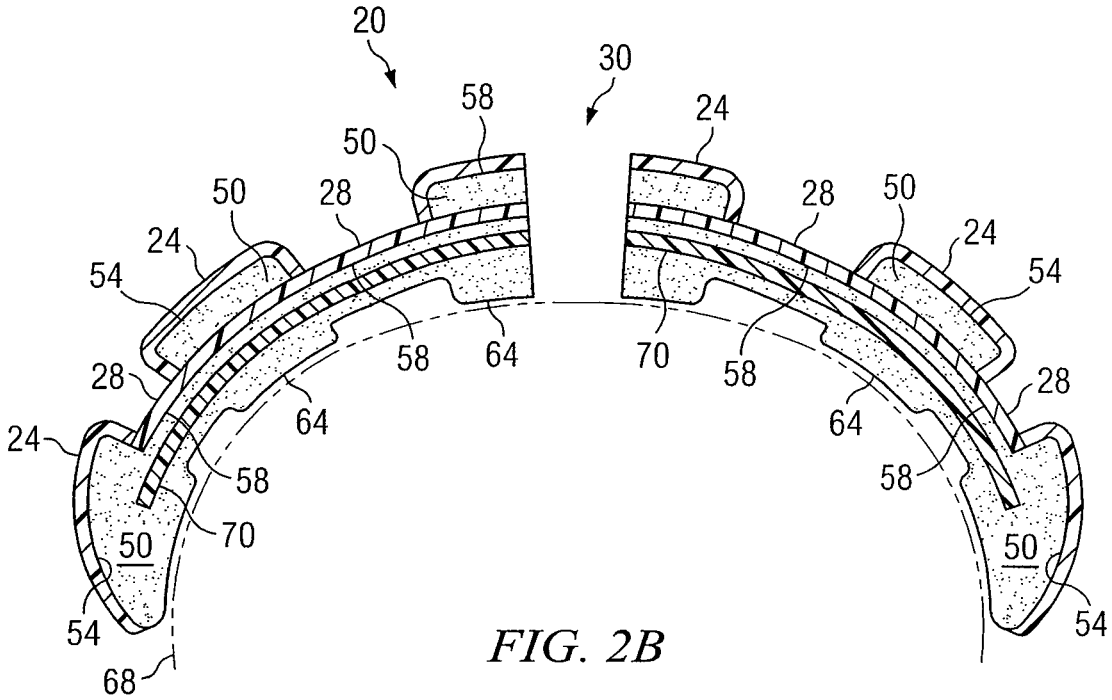
FIG. 2B is a schematic diagram illustrating a cross-sectional view of the helmet shown in FIG. 2A.

FIG. 2A is a schematic diagram illustrating a perspective view of one embodiment of helmet 20 shown in FIG. 1. FIG. 2B is a schematic diagram illustrating a cross-section of helmet 20 at a phantom line 26 shown in FIG. 2A. Referring to FIG. 2A, helmet 20 defines a plurality of holes 30 in a particular pattern. Referring to FIG. 2B, helmet 20 comprises a body 50 having a primary outer surface 54, recessed outer surfaces 58, and an inner surface 64. Helmet 20 also comprises a protective layer or shell 24 disposed on outer surfaces 54, one or more support layers 28 disposed at least partially on recessed outer surfaces 58 and at least partially within body 50, and a roll cage 70 disposed substantially within body 50.

Body 50 may formed from any suitable material that can protect head 16 of user 20. An example of such a material includes, but is not limited to, expandable polystyrene (EPS). As shown in FIG. 2A and more clearly in FIG. 2B, in certain embodiments, body 50 does not have a consistent thickness. For example, as shown in FIG. 2B, outer surfaces 54 are disposed farther from inner surface 64 than recessed outer surfaces 58. Portions of body 50 may have different thicknesses for various design reasons, such as weight reduction, ventilation, an increase in aesthetic value, and enhancement of aerodynamic characteristics of helmet 20. Outer surfaces 54 and 58 are jointly referred to as outer surfaces 60. In some embodiments, body 50 may have an approximately consistent thickness and an approximately continuous outer surface 60. Other embodiments have holes—and thus non-continuous outer surface—without having recessed outer surfaces.

Referring again to both FIGS. 2A and 2B, protective layer 24 is disposed on outer surface 54. Protective layer 24 may be formed from any suitable material, such as polycarbonate plastic, and is used to protect body 50 of helmet 20. Protective layer 24 may also be used to add color, pictures, patterns, and any other design elements to helmet 20.

As shown in both FIGS. 2A and 2B, according to certain embodiments of the invention, support layer 28 is provided that at least partially overlies outer surfaces and is disposed at least partially within body 50. However, in certain embodiments, support layer 28 may be disposed entirely within body 50 or may overlie outer surface 58 and/or outer surface 54 without being disposed within body 50. In certain embodiments, helmet 20 having support layer 28 may not have roll cage 70. Support layer 28 may be appropriately patterned to accommodate holes 30, and may be formed from a material that is tougher than body 50 and that may also be tougher than protective layer 24. An example of a material that may be used to form support layer 28 includes, but is not limited to, a carbon fiber material. In some embodiments, support layer 28 may be formed from thermoplastic composite laminate (TPL). An example TPL may comprise a carbon fiber layer and a fiber glass layer that are positioned between acrylic layers. Using such TPL as support layer 28 is advantageous in some embodiments because when support layer 28 is in-molded into body 50, the heat applied to form body 50 may melt the acrylic layers and help bond support layers 28 to body 50. This may be advantageous in some embodiments where body 50 is formed from EPS because melted acrylic bonds well to EPS. Using support layer 28 formed from material such as carbon fiber is advantageous in some embodiments because support layer 28 enhances the appearance of helmet 20 while improving the structural integrity of helmet 20. Additional details concerning roll cage 70 are provided below in conjunction with FIG. 2C.

Figure 2C:
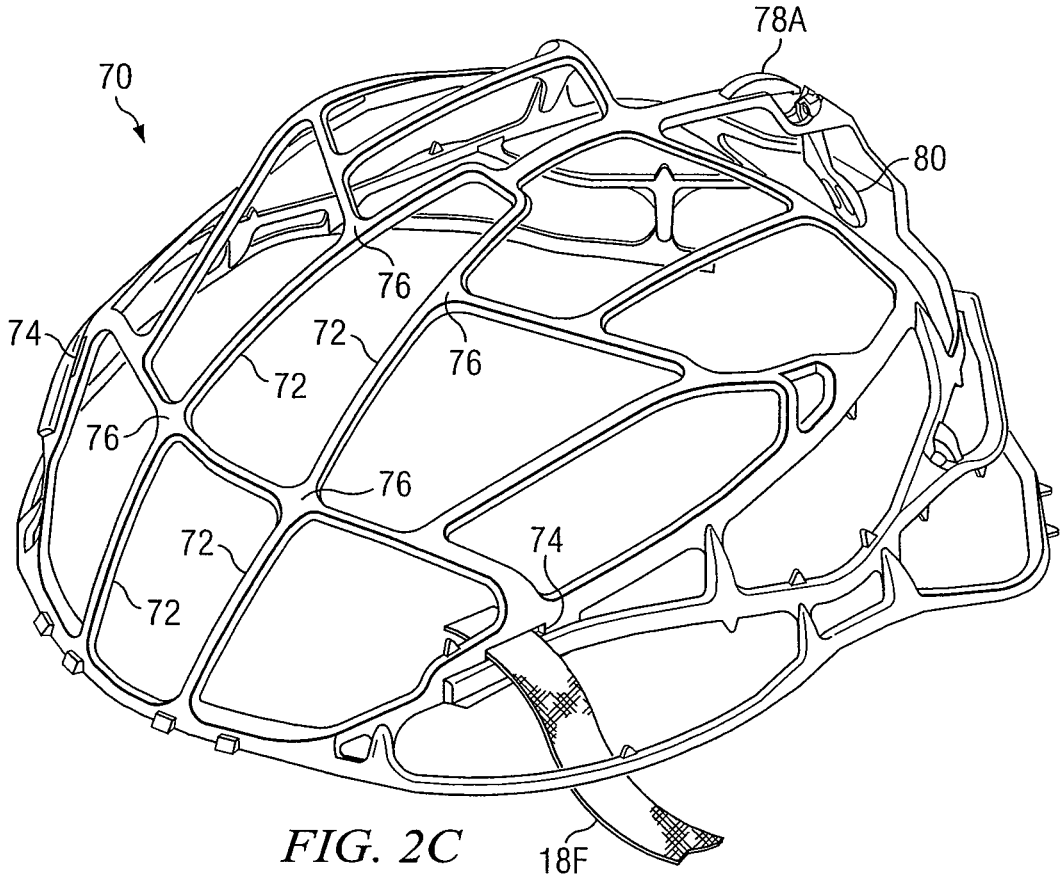
FIG. 2C is a schematic diagram illustrating a perspective view of one embodiment of a roll cage that may be positioned within the body of the helmet shown in FIG. 2A.

FIG. 2C is a schematic diagram illustrating a perspective view of one embodiment of roll cage 70 that may be positioned within helmet body 50 shown in FIGS. 2A and 2B. FIG. 2D is a schematic diagram illustrating an attachment point 78A of roll cage 70 shown in FIG. 2C. Referring to FIG. 2C, roll cage 70 comprises a plurality of members 72 that are joined with each other through a plurality of junctions 76. Roll cage 70 may be used to improve the structural integrity of helmet 20. According to some embodiments of the invention, roll cage has slots 74 and/or attachment point 78A used to couple straps 18 to roll cage 70. For example, each slot 74 is used for directly coupling an end portion of strap 18, such as front strap 18F shown in FIG. 1, to roll cage 70. Slots 74 may also be used for indirectly coupling an end portion of strap 18, such as front strap 18F. Attachment point 78A is used for coupling a strap hanger 80 to roll cage 70, which is used to couple strap 18, such as rear strap 18R, to roll cage 70.

Using roll cage 70 to secure straps 18 and strap hanger 80 to helmet 20 is advantageous in some embodiments because straps 18 (shown in FIG. 1) and strap hanger 80, which are parts of the helmet retention system, can be securely coupled to helmet 20 without anchoring straps 18 and strap hanger 80 through or in the material that comprises body 50 of helmet 20. In some embodiments, straps 18 and/or strap hanger 80 are attached either directly or indirectly to roll cage 70 via slots 74 and attachment point 78A, respectively, so that any force or load applied to straps 18 and/or strap hanger 80 is transferred to roll cage 70 before being transferred to body 50. In certain embodiments, straps 18 and/or strap hanger 80 are attached either directly or indirectly to roll cage 70 via slots 74 and attachment point 78A, respectively, so that a substantial portion of force or load applied to straps 18 and/or strap hanger 80 is transferred to roll cage 70. An example of "a substantial portion" of force/load includes, but is not limited, to more than 50% of the force/load. Because roll cage 70 is formed from a suitably tough material, such as ZYTEL ST 801™ available from DuPont, and is disposed over a substantial portion of body 50, a sufficient retention of helmet 20 on head 16 of user 12 may be provided in conjunction with a sleek outer appearance without using anchors that are visible from the exterior of helmet 20 and/or compromising the effectiveness of the coupling between body 50 and strap 18 and/or strap hanger 80.

In some embodiments, straps 18 and strap hanger 80 may be secured to roll cage 70 and also to other portions of body 50. For example, straps 18 and strap hanger 80 may be anchored through body 50 and also secured to roll cage 70. Such embodiments may be used to provide a stronger coupling of straps 18 and strap hanger 80 to body 50. In such embodiments, force/load may not necessarily be transferred to roll cage 70 before being transferred to body 50.

Strap 18, such as front strap 18F, may be secured to slot 74 using any suitable method, such as by anchoring strap 18 through slot 74. For example, where front strap 18F has two end portions, the first end portion is folded and stitched to provide an end that is thicker than the size of slot 74. The folding and the stitching of an end portion of strap 18 may be referred to as "bar-tacking." Then the second end portion is inserted through slot 74 so that strap 18 is anchored through slot 74 by the stitched first end. However, strap 18 may be coupled to roll cage 70 using any suitable method that may nor may not incorporate the use of slot 74.

Referring to FIG. 2D, in certain embodiments, attachment point 78A comprises an approximately "V" or "U" depression 82 that defines an opening 86 configured to receive attachment point 78B of strap hanger 80. As shown in FIG. 2D, attachment point 78B is shaped so that attachment point 78B may squeeze through opening 86 and anchor on to attachment point 78A at depression 82. Depression 82 and attachment point 78B are shaped so that strap hanger 80 is allowed a certain level of rotational and translational movement. Additional details concerning strap hanger 80 are provided below in conjunction with FIGS. 3A-3B. Although one embodiment of attachment point 78A is shown in FIG. 2D, any suitable configuration may be used that allows strap hanger 80 to be secured to roll cage 70.

Figure 3A:
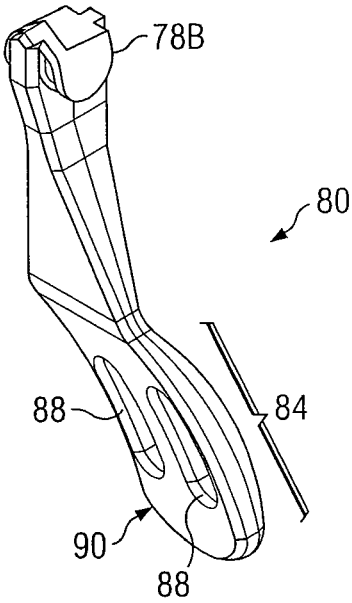
FIGS. 3A and 3B are schematic diagrams illustrating a perspective view and a front view, respectively, of one embodiment of a strap hanger that may be coupled to the roll cage shown in FIG. 2C.
Figure 3B:
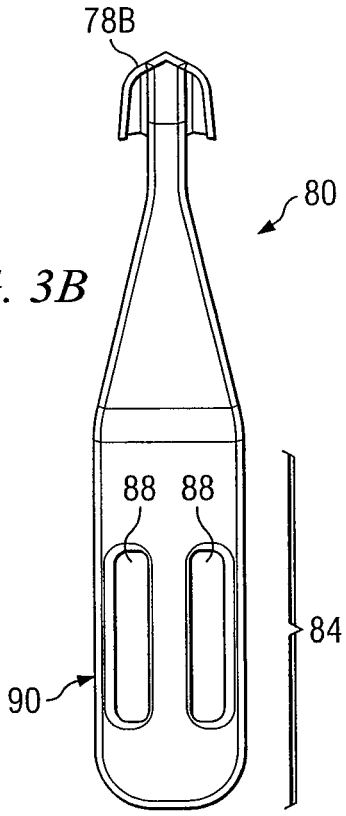

FIGS. 3A and 3B are schematic diagrams illustrating a perspective view and a front view, respectively, of one embodiment of strap hanger 80 that may be coupled to roll cage 70 shown in FIG. 2D. Referring to both FIGS. 3A and 3B, strap hanger 80 comprises an attachment point 78B for coupling to attachment point 78A of roll cage 70 shown in FIG. 2D and a slot portion 84 that comprises slots 88 and a face 90. Referring to both FIGS. 2D and 3A, attachment point 78A of roll cage 70 and attachment point 78B of strap hanger 80 may have a suitable reciprocal configuration so that attachment point 78B can be secured to attachment point 78A. In some embodiments, attachment point 78A may be a female end and attachment point 78B may be a male end that can securely engage attachment point 78A. Although roll cage 70 and strap hanger 80 are shown as separate devices, in certain embodiments, strap hanger 80 may be formed as an integral part of roll cage 70.

Referring back to FIGS. 3A and 3B, slots 88 are appropriately sized to receive a strap 18, such as rear strap 18R shown in FIG. 1. Strap 18 may be threaded through slots 88 to slidably secure strap 18 to helmet 20. In some embodiments, a face 90 of strap hanger 80 has a curvature that has approximately the same radius of curvature as the internal curvature defined by inner surface 64 (shown in FIG. 2B) of helmet 20. This is advantageous in certain embodiments because when user 12 is wearing helmet 20, the curvature of face 90 approximately conforms to the contour of head 16 of user 12, which enhances the level of comfort for user 12. In some embodiments, strap hanger 80 may be disposed in a recess in inner surface 64 of helmet 20 such that face 90, together with inner surface 64, defines an approximately continuous inner surface.

Figure 4:
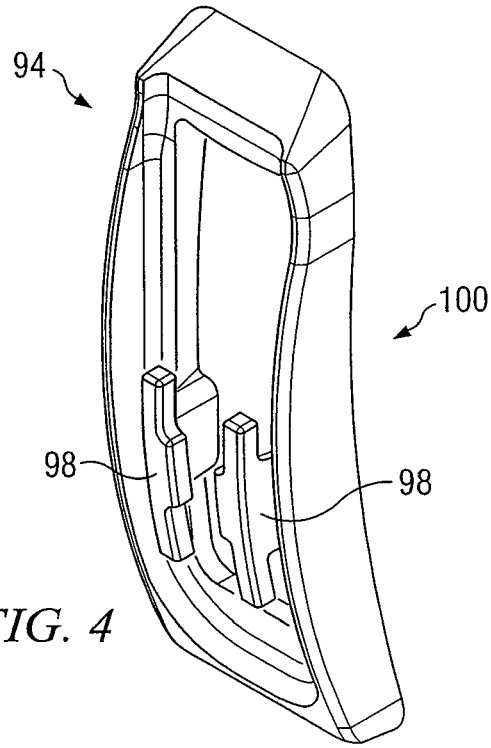
FIG. 4 is a schematic diagram illustrating a prospective view of one embodiment of a slot cover that may be used in conjunction with the strap hanger shown in FIGS. 3A and 3B.

FIG. 4 is a schematic diagram illustrating a prospective view of a slot cover 94 that may be used in conjunction with strap hanger 80 shown in FIGS. 3A and 3B. Slot cover 94 comprises members 98 positioned opposite from a face 100. In some embodiments, members 98 are suitably shaped and sized so that members 98 may be inserted into slots 88 of strap hanger 80 shown in FIGS. 3A and 3B.

Referring to FIGS. 3A, 3B, and 4, during the manufacturing process of helmet 20, slot cover 94 may be coupled to face 90 of slot portion 84 by inserting members 98 through slots 88. Slot cover 94 is coupled to slot portion 84 so that face 100 is oriented towards inwardly to face head 16 of user 12. In some embodiments, face 100 defines a curvature approximately equal to the curvature of face 90 of slot portion 84. The use of slot cover 94 is advantageous in certain embodiments because the material used to form body 50 of helmet 20, such as EPS, is prevented from clogging slot 88 of strap hanger 80 during the manufacturing process. Further, in certain embodiments where body 50 is molded, covering slot portion 84 using slot cover 94 during the molding process results in a formation of a recess in body 50 where strap hanger 80 may be nested. After performing the molding process with slot portion 84 covered by slot cover 94, slots 88 of strap hanger 80 is made accessible by removing slot cover 94 from strap hanger 80 after body 50 is formed.

Although straps 18 and strap hanger 80 are used as example portions of a helmet retention system that may be coupled to roll cage 70, the coupling of any portion of the helmet retention system so that a substantial portion of load applied to the helmet retention system is transferred to roll cage 70 is within the scope of some embodiments of the invention. The coupling of any portion of the helmet retention system to roll cage 70 so that load/force applied to the helmet retention system is transferred to roll cage 70 before being transferred to body 70 is also within the scope of some embodiments of the invention.

Figure 5:
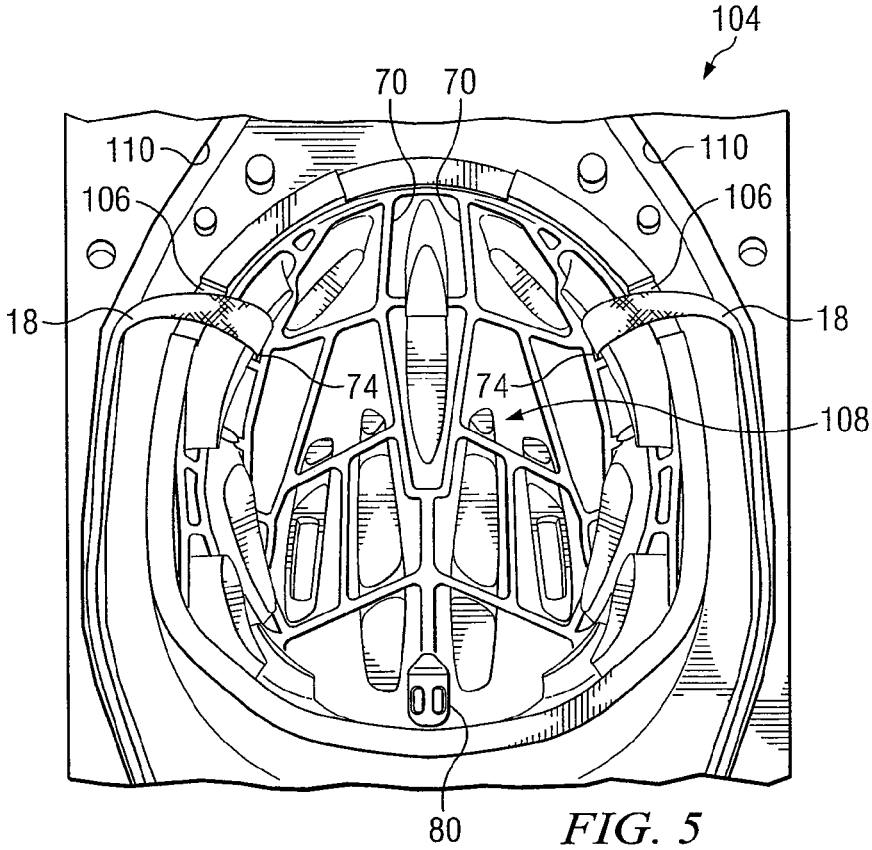
FIG. 5 is a schematic diagram illustrating one embodiment of a mold that may be used to form the helmet shown in FIG. 2A.
Figure 6:
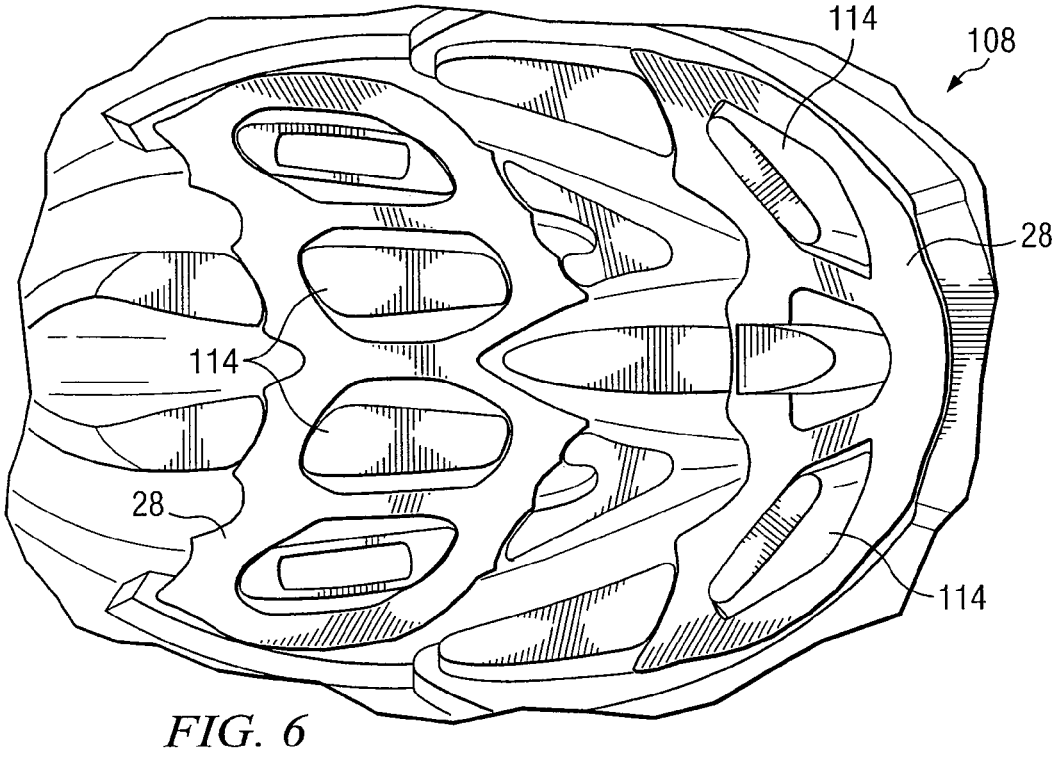
FIG. 6 is a schematic diagram illustrating one embodiment of a support layer shown that is positioned in the mold shown in FIG. 5.

FIG. 5 is a schematic diagram illustrating one embodiment of a female-half of a mold 104 that may be used to form helmet 20 shown in FIG. 2A. FIG. 6 is a schematic diagram illustrating one embodiment of support layer 28 shown in FIGS. 2A-2B positioned in mold 104 shown in FIG. 5 as part of a helmet manufacturing process. Referring to and as shown in FIG. 5, mold 104 defines a bowl 108 that generally has a concave shape corresponding to outer surfaces 54 and 58 of helmet 20. Referring to FIG. 6, support layers 28 may be positioned inside bowl 108 of mold 104 so that support layers 28 may be in-molded in body 50 during the molding of helmet 20. Bowl 108 may define appropriate slots to fix support layers 28 in their appropriate position during the manufacturing process. FIG. 6 shows two separate support layers 28 each defining a plurality of apertures 114 that are patterned to align with the pattern of holes 30 defined by body 50 of helmet 20 (shown in FIGS. 2A-2B). However, more or less support layers 28 may be used depending on the particular design of helmet 20. In certain embodiments, support layers 28 are aligned in bowl 108 of mold 104 so that, when body 50 is formed, some portions of support layers 28 are disposed within the material that is used to form body 50, such as EPS, while other portions of support layers 28 are positioned over recessed outer surfaces 58 to be visible.

Referring back to FIG. 5, roll cage 70 is positioned in bowl 108 to in-mold roll cage 70 into body 50 of helmet 20. In some embodiments, roll cage 70 is positioned in bowl 108 after protective layer 24 and support layers 28 are positioned in bowl 108. According to some embodiments of the invention, mold 104 also defines one or more grooves 110 configured to receive straps 18 that are coupled to roll cage 70. In order to form helmet 20 with straps 18 and strap hanger 80 that are coupled to roll cage 70, mold 104 may define one or more recesses 106 that allow straps 18 to fit between female-side mold 104 and a corresponding male-side mold (not explicitly shown in FIGS. 5 and 6) when female-side mold 104 and the male-side mold are joined and be positioned in grooves 110, as shown in FIG. 5. In some embodiments, straps 18 are positioned within grooves 110 during the molding process so that the portions of strap 18 inside bowl 108 and groove 110 have approximately the same experience during the molding process. For example, when steam is introduced to apply heat, portions of strap inside bowl 108 and groove 110 experience approximately the same level of heat and moisture. This is advantageous in some embodiments because exposing strap 18 to a similar experience allows strap 18 to maintain a consistent shape throughout the length of strap 18.

Referring to FIGS. 2A-6, in certain embodiments, helmet 20 may be molded through the following process. Female-side mold 104 and a corresponding male-side mold is provided. Protective layer 24 defining a suitable pattern of holes 30 is positioned in bowl 108 of mold 104. Then one or more support layers 28 are positioned in bowl 108. After support layers 28 are provided, roll cage 70 that is coupled to front straps 18F and strap hanger 80 is positioned in bowl 108. Face 90 of strap hanger 80 is coupled to slot cover 94. Then front straps 18F are positioned in their corresponding grooves 110 through recesses 106. After front straps 18F are positioned in grooves 110, the male-side mold is fitted over mold 104 and EPS provided in the chamber formed by mold 104 and the male-mold. For example, EPS may be provided by drawing the EPS into the chamber by vacuum. After EPS is provided in the chamber, a suitable level of heat is applied to form the EPS into body 50 of helmet 20. For example, the EPS in the chamber may be exposed to steam.

Although some embodiments of the present invention have been described in detail, it should be understood that various changes, substitutions, and alterations can be made hereto without departing from the spirit and scope of the invention as defined by the appended claims.

What is claimed is:

1. A method for coupling a retention system with a helmet, comprising:

providing a roll cage operable to be positioned substantially within a helmet body;

coupling a strap hanger to the roll cage so that a force applied to the strap hanger is transferred to the roll cage before being transferred to the helmet body, the strap hanger having a slot portion defining at least one slot, the slot portion operable to slidably secure a strap through the slot such that the strap may slide through the slot; and forming the helmet body that substantially encompasses the roll cage and a portion of the strap hanger without preventing access to the slot portion of the strap hanger, wherein forming the helmet body comprises forming the helmet body having a rear portion and an inner surface that defines a recess formed in the helmet body, and coupling the strap hanger to the roll cage comprises directly coupling the strap hanger to the roll cage so that the slot portion is disposed at least partially in the recess.

2. The method of claim 1, wherein coupling the strap hanger comprises forming the strap hanger as an integral part of the roll cage.

3. The method of claim 1, wherein forming a roll cage comprises forming the roll cage from a plastic material, and forming a helmet body comprises forming a helmet body from expandable polystyrene.

4. The method of claim 1, and further comprising:

coupling a slot cover to the slot portion before forming the helmet body, the slot cover comprising at least one member configured to be inserted into the at least one slot of the slot portion; and removing the slot cover after forming the helmet body.

5. The method of claim 1, wherein forming the helmet body comprises molding the helmet body around the roll cage.

6. The method of claim 1, wherein the inner surface of the helmet body has a first curvature, and further comprising:

defining the recess at the inner surface by coupling a slot cover having a continuous face to the slot portion before forming the helmet body, the slot cover comprising at least one member positioned opposite from the continuous face and configured to be inserted into the at least one slot of the slot portion; and removing the slot cover after forming the helmet body;

wherein forming the helmet body comprises molding the helmet body using the continuous face of the slot cover as a part of the inner surface of the helmet body.

* * * * *